United States Patent [19]

Chapman

[11] Patent Number: 4,598,512

[45] Date of Patent: Jul. 8, 1986

[54] SINGLE BRACKET SUPPORT AND METHOD

[75] Inventor: Nicholas Chapman, Fremont, Calif.

[73] Assignee: Fencemender Corp., Newark, Calif.

[21] Appl. No.: 682,308

[22] Filed: Dec. 17, 1984

Related U.S. Application Data

[63] Continuation-in-part of Ser. No. 441,050, Nov. 12, 1982, Pat. No. 4,516,365.

[51] Int. Cl.[4] ..... E02D 5/74

[52] U.S. Cl. ..... 52/165; 52/170; 405/232

[58] Field of Search ..... 52/170, 153–155, 52/158, 165, 166, 296, 742; 405/216, 245, 232; 256/32

[56] References Cited

U.S. PATENT DOCUMENTS 3,173,661 3/1965 Kruger ..... 52/155 X 3,738,072 6/1973 Adrian ..... 52/170

FOREIGN PATENT DOCUMENTS 52610 3/1911 Switzerland ..... 52/165

*Primary Examiner*—Carl D. Friedman

*Assistant Examiner*—Naoko N. Slack

*Attorney, Agent, or Firm*—Willis E. Higgins

[57] ABSTRACT

A bracket (90) fixedly supports a structural member (120) with respect to an aperture (128). The bracket (90) has a semicircular cross section body (100) with one end portion (94) for placement on the structural member. A second end portion (96) extends into aperture (128). The bracket body (100) has a plurality of longitudinally extending corrugations (92) along the body. A wedge shaped driving member (98) extends outward from the body (100) and extends between the first and second body portions (94) and (96). A clamp (130) and/or screws (188) fasten the first bracket body portion (94) to the structural member (120) or (180). In use, the bracket (90) is driven into the aperture (128) by striking the driving member (98). The driving member (98) and the corrugations (92) coact with the aperture (128) to provide a camming action, which expands the bracket body end (96) in at least one dimension to hold the bracket (90) tightly in the aperture (128). As a result of this expansion, a single bracket (90) will provide sufficient support for the post (120) in most applications.

9 Claims, 15 Drawing Figures

SINGLE BRACKET SUPPORT AND METHOD

IDENTIFICATION OF PRIOR APPLICATION

This application is a continuation-in-part of my earlier application Ser. No. 06/441,050, filed Nov. 12, 1982, now U.S. Pat. No. 4,516,365 and entitled "Support Assembly and Method". Benefit of that filing date for subject matter common to that application and this application is claimed.

BACKGROUND OF THE INVENTION

1. Field of the Invention

This invention relates to a support for fixedly attaching a structural member with respect to a rigid aperture, which support is formed from a single bracket, and an attaching method utilizing such a single bracket. More particularly, it relates to such a single bracket support and method which is especially adapted for use in repairing otherwise structurally sound wood fences having fence posts originally set in concrete or in rigid soil that have rotted below ground level, and for similar applications.

In my parent application, an assembly and method for attaching structural members with respect to an aperture, utilizing a pair of brackets for each fence post or other structural member is described. It has been discovered that certain embodiments of the brackets there described may be used singly, without an opposing bracket.

2. Description of the Prior Art

A wide variety of metal sleeves and similar members have been used to support poles, fence posts and the like in the ground. Examples of such prior art, sleeves and brackets are of record in my above-identified parent application. For example, Wiley, U.S. Pat. No. 1,784,770, issued Dec. 9, 1930, discloses a sleeving assembly for joining two sound portion of a pole separated by a rotten portion using a plurality of interlocking corrugated strips. That assembly entirely surrounds a pole with which it is used. The corrugations in that assembly compensate for slight changes in pole diameter. Fisher, U.S. Pat. No. 94,195 discloses a fence post sleeve terminating in a wedge shaped bottom, so that it may be easily driven into the ground for use. These and other prior art structures have not achieved wide application in the repair of rotted fence posts. A need therefore remains for further improvement in support brackets and support methods utilizing such brackets.

SUMMARY OF THE INVENTION

Accordingly, it is an object of this invention to provide an improved support bracket and method for supporting a structural member with respect to a rigid aperture in which a single support bracket may be used.

It is a further object of the invention to provide such a support and method in which a portion of the bracket is expanded in at least one dimension into fixed engagement with the rigid aperture.

It is a further object of the invention to provide such a support bracket and method in which the bracket may be used with fence posts or other structural members of different sizes.

The attainment of these and related objects may be achieved through the use of the novel support bracket and method herein disclosed. A support bracket in accordance with this invention fixedly supports a structural member with respect to an aperture. The bracket has a generally channel-shaped body. One end portion of the body has opposing surfaces for placement on either side of the structural member. The body has a second end portion configured to extend longitudinally beyond the end of the structural member and enter the aperture. The bracket body has a plurality of corrugations extending longitudinally along the bracket body. The bracket body further has a wedge-shaped impact receiving portion extending outward from the body and extending between the first and second portions of the body. The impact receiving portion and the corrugations coact with the structural member and a wall of the aperture to provide a camming action, which expands the bracket in at least one dimension to hold the bracket tightly in the aperture. A plurality of holes and/or other attaching means, such as bands or clamps, is provided along the opposing sides of the first end portion of the body for fixedly attaching the first body portion to the structural member.

In one form of the invention, the first and second opposed surfaces are on first and second sides of each bracket and the corrugations are on a third side extending between the first and second sides. In another form of the invention, the bracket has a curved, approximately half round cross section to form the first and second opposing surfaces.

In practice of the method of this invention for fixedly attaching a structural member with respect to a rigid, fixed aperture, a bracket with first ends having camming surfaces configured to be driven into the rigid, fixed aperture and expand the bracket in at least one dimension into tight engagement with the aperture, and a second end configured for attachment to the post above ground level is positioned along the structural member to enter the rigid, fixed aperture, the first end of the bracket is driven into the aperture to expand in at least one dimension in such tight engagement with the aperture and the second end is fixedly attached to the post.

By providing such camming surfaces to expand the bracket in at least one dimension into tight engagement with a rigid, fixed aperture, only a single bracket may be used in accordance with the method and the support to fix a post or other structural member with respect to an aperture. This reduces cost and simplifies installation compared with the assembly and method as described in my above identified parent application.

The attainment of the foregoing and related objects, advantages and features of the invention should be more readily apparent to those skilled in the art, after review of the following more detailed description of the invention, taken together with the drawings, in which:

DETAILED DESCRIPTION OF THE INVENTION

Figure 1:
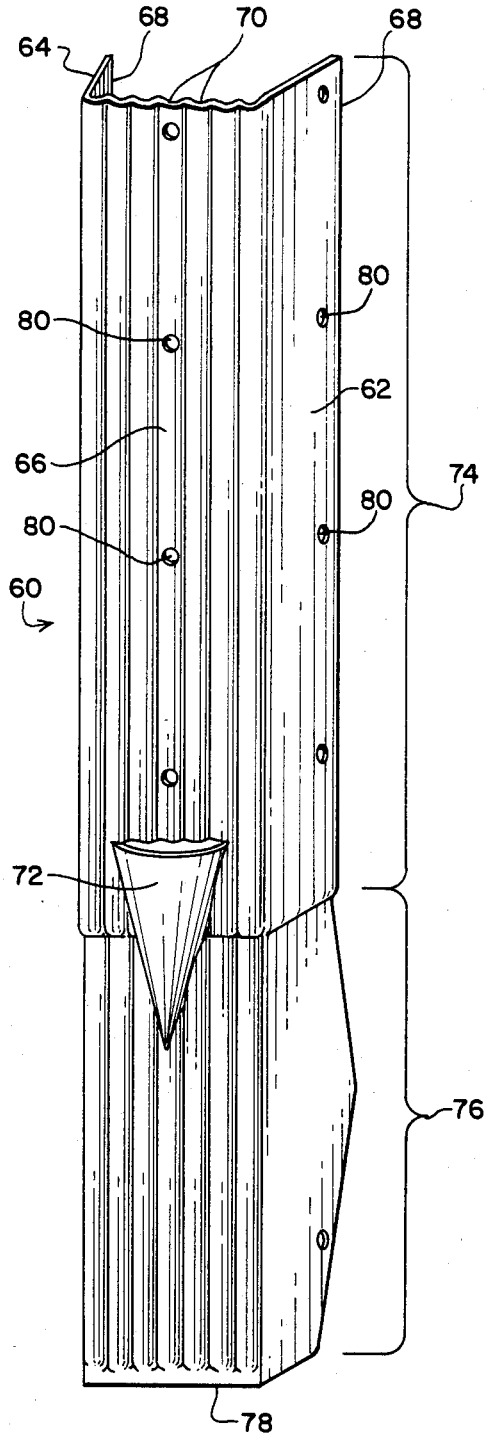
FIG. 1 is a perspective view of a support bracket in accordance with the invention.

Turning now to the drawings, more particularly to FIG. 1, there is shown a bracket 60 that may be used with different size fence posts, and which will expand in at least one dimension into tight engagement with a concrete, hard dirt or other rigid aperture when installed. The bracket 60 has a first and second side 62 and 64, each of which sides 62 and 64 flare outwards slightly from a third side 66 joining the first and second sides 62 and 64. For example, if side 66 is 3.5 inches in width, sides 62 and 64 flare outward, so that their edges 68 are four inches apart. Side 66 is corrugated as indicated at 70. A conical shaped driving member 72 is provided extending between a first portion 74 and a second portion 76 of the bracket 60.

In use of the bracket 60 shown in FIG. 1 to practice the method of this invention, the bracket 60 is placed along a post with end 78 of the second portion 76 extending into a concrete or other rigid, fixed aperture with respect to which the post is to be fixedly supported. Cone shaped portion 72 of the bracket 60 is then used to pound the bracket 60 over the post and into the aperture 14. In this process, the portion 72 and the corrugations 70 of the bracket 60 coact in a camming action as the sides 62 and 64 are brought together to enter the aperture with the walls of the fixed, rigid aperture to expand sides 62 and 64 in the portion 76 of the bracket along the aperture walls into tight engagement with the aperture, so that only the single support bracket 60 need be used for most applications. Where a post is subjected to strong forces, such as from high winds blowing against a fence, a pair of opposing brackets 60, in accordance with the teachings of the parent application, may be required for optimum support. To complete the installation of the bracket 60, first portion 74 of the bracket 60 is fixedly attached to the post, such as with screws through apertures 80 on the sides 62, 64 and 66 of the bracket 60. Further details on the use of the bracket 60 are provided by the description of the usage of the FIG. 2 embodiment of the invention, in connection with FIGS. 3–6 of the drawings.

Figure 2:
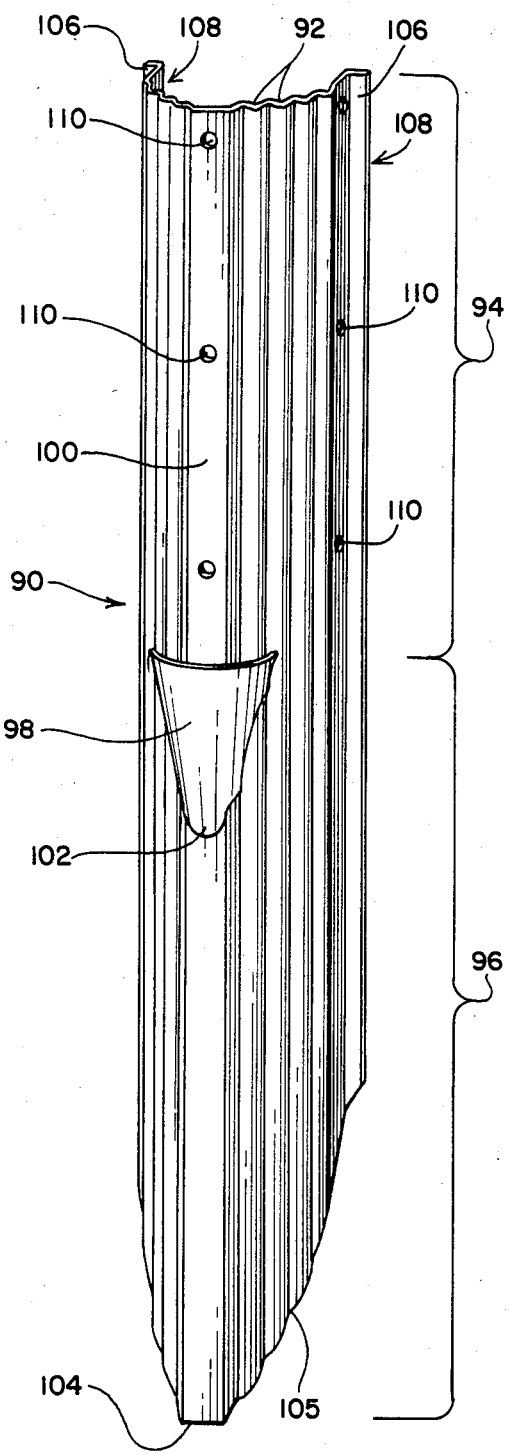
FIG. 2 is a perspective view similar to that of FIG. 1, of another embodiment of the invention.
Figure 6:
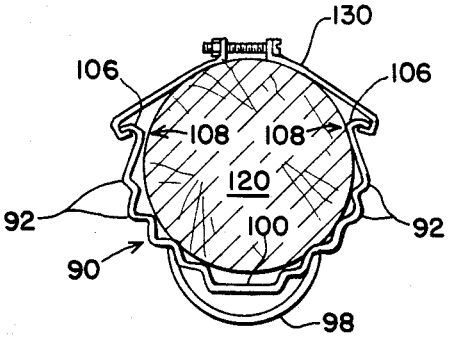
FIG. 6 is a similar cross section view, taken along the line 6—6 in FIG. 4.

FIGS. 2 and 6 show another bracket support 90 in accordance with the invention. As is best shown in FIG. 6, the bracket 90 has a generally semicircular cross section along its length. As in the case of the FIG. 1 embodiment, the bracket 90 has corrugations 92 extending along its length. The bracket 90 includes a first portion 94 and a second portion 96. A conical shaped driving wedge member 98 is positioned connecting the portions 94 and 96, and extends outward from body 100 of the bracket 90, with apex 102 of the driving member 98 extending toward end 104 of the portion 96. Body 100 of the bracket 90 has clamping curls 106 extending along edges 108 of the body 100. End 104 of the portion 96 tapers to a reduced size as shown. A plurality of apertures 110 are provided through the portion 94 of the bracket, for fixed attachment to a post or other structural member with screws or similar fasteners. In use, the bracket 90 fixedly attaches a post or other structural member with respect to a concrete, hard dirt or other rigid, fixed aperture in a similar manner to the FIG. 1 embodiment.

Further details on the use of the FIG. 2 embodiment are provided in FIGS. 3–6. While these figures depict use of the bracket 90, it should be recognized that the description is generally applicable to the use of the bracket 60 in FIG. 1 as well.

Figure 3:
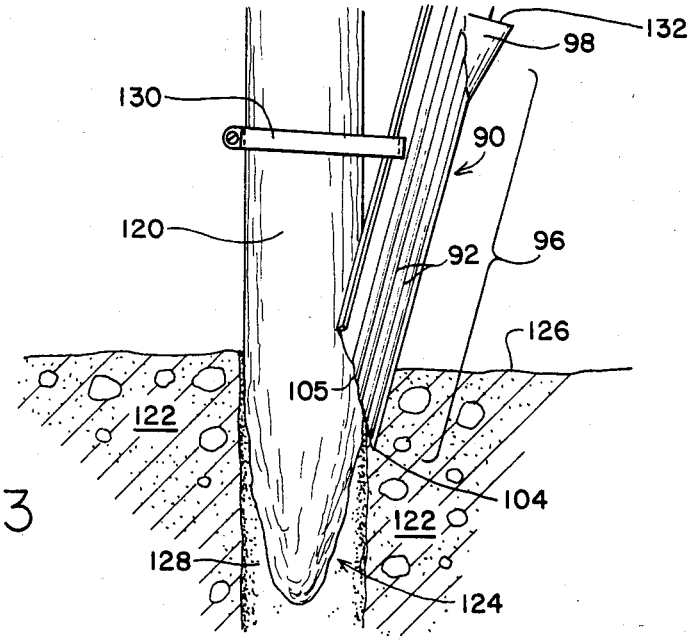
FIG. 3 is a side view of the embodiment of FIG. 2 in the process of use.
Figure 4:
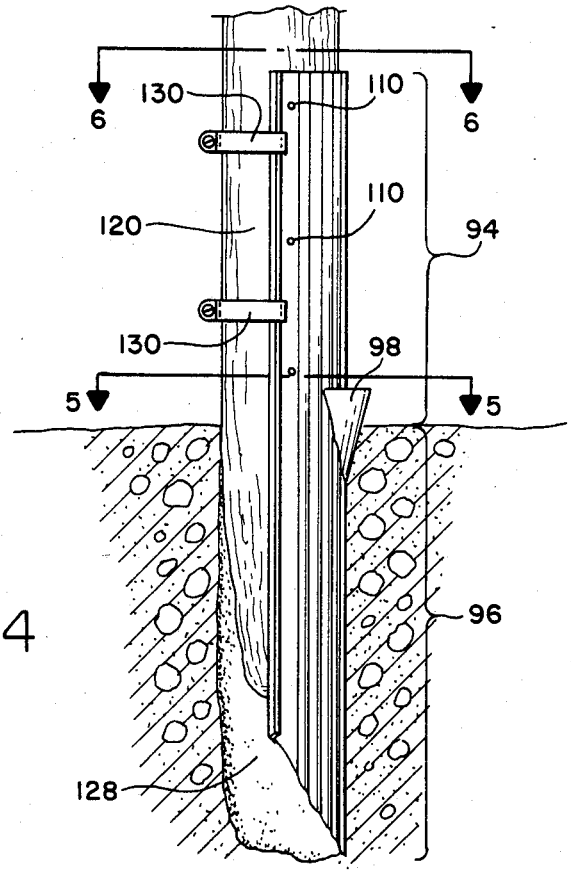
FIG. 4 is a side view similar to that of FIG. 3, but with the installation completed.
Figure 5:
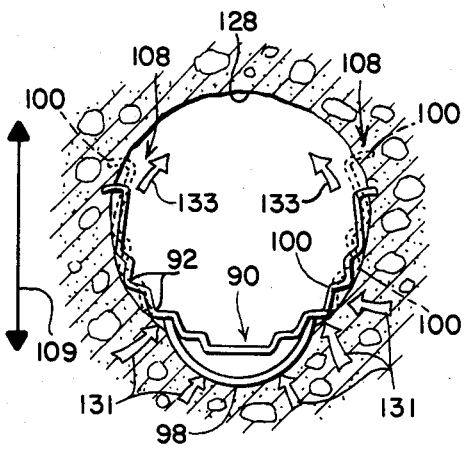
FIG. 5 is a cross section view, taken along the line 5—5 in FIG. 4.
Figure 7A:
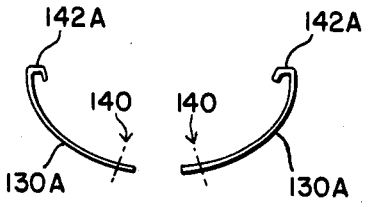
FIGS. 7A through 7E are top views of accessory clamps useful with the invention.
Figure 7B:
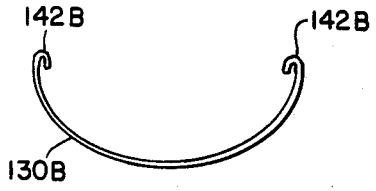

FIG. 3 shows the beginning of installation of the bracket 90 to repair a pre-existing fence post 120, originally set in concrete 122. As shown at 124, the fence post 120 has rotted away below ground level 126 to form an aperture 128 in the concrete 122, corresponding to the original cross section dimensions of the post 120 within the concrete 122. The bracket 90 is placed as shown, generally extending along the post 120, above the ground level 126, with tapered end 104 extending into the aperture 128. Tapered edges 105 of the end 104 guide the bracket into the aperture 128 and begin compressing edges 108 of the bracket toward one another so that the bracket portion 96 will fit into the aperture. As the edges 108 move toward one another, the bracket expands along the direction shown by arrow 109 (FIG. 5). If desired, one or more tightenable bands 130 are placed in loose engagement with the clamping curls 106 (see also FIG. 6) and extending around the post 120. A mallet, hammer or similar implement is then used to provide driving force impacts against top 132 of the driving wedge 98. Such driving force on the wedge 98 is continued until the bracket 90 reaches the position shown in FIG. 4, with the portion 96 extended fully into the aperture 128 and the portion 94 around the post 120. As the corrugations 92 of portion 96 and the wedge 98 enter the aperture 128, they interact with the aperture 128 to produce a camming effect, indicated by arrows 131, which causes the corrugations 92 and the wedge 98 to flatten somewhat, so that the body 100 of the bracket 90 tends to expand further against the aperture 128, as shown in dotted line in exaggerated form in FIG. 5 and indicated by arrows 133, especially near edges 108 of the body 100. Such a camming action from the tapered edge 105, the corrugations 92 and the wedge 98 to produce expansion of the bracket 90 against the concrete aperture 128 is important for providing sufficient rigidity in the position of the bracket 90 within aperture 128, as shown in FIG. 4, to provide adequate support for the post 120 with a single bracket 90. In practice, it has been found that both the corrugations 92 and the driving wedge 98 entering the aperture 128 are required to achieve adequate support. For severe use conditions, a pair of the brackets 90 can be employed, as disclosed in the above identified parent application.

In addition to providing a structure for engagement by the optional clamping band 130, the clamping curl 106 provides an enhanced biting force against the concrete aperture 128, thus increasing the tightness of the bracket 90 within the aperture 128, as a result of the expansion of the body 100 caused by the camming action of the corrugations 92 and the wedge 98.

To complete the installation of the bracket 90, as shown in FIGS. 4 and 6, the clamps 130 are tightened against the post 120. For further fixed attachment to the post 120 screws, nails or similar fasteners are driven into the post 120 through the apertures 110.

Figure 7C:
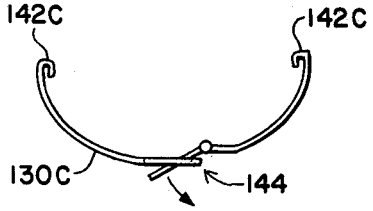
Figure 7:
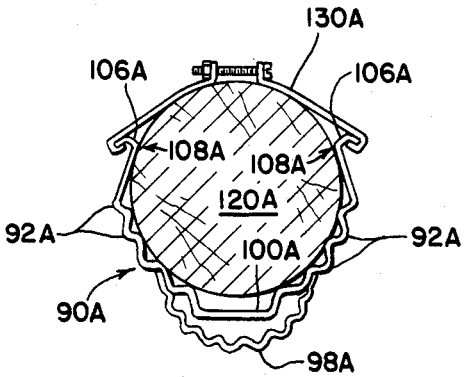
Figure 7D:
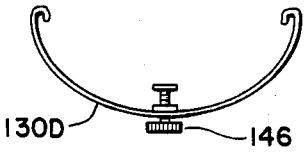
Figure 7E:
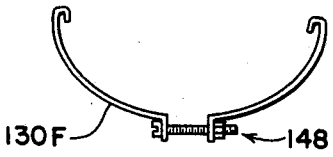

FIG. 7 shows another embodiment of a bracket 90A in accordance with the invention. Wedge 98A is corrugated in addition to the corrugations on body 100A.

This means that the wedge 98A can be fabricated out of the same gauge sheet metal as body 100A and has equivalent strength to the thicker walled wedge 98 in the FIGS. 2–6 embodiment. If desired, the wedge 98A can be cut and stamped as an integral piece from the body 100A, rather than welded to the body as in the wedge 98 and body 100. In other respects, the design and use of the FIG. 7 embodiment is the same as the FIGS. 2–6 embodiment.

FIGS. 7A–7E show alternative clamps 130A through 130F, which may be used with the bracket 90 of FIGS. 2–6. The clamps 130A have apertures 140, which may be used to attach the clamps to the post or other structural member, either before or after the curls 142A are used to engage the clamping curls 106 on the bracket 90. The clamp 130B is fabricated from a flexible, spring metal, so that curls 142B can be placed in locking engagement with the mating clamping curls 106 on the bracket 90. Locking lever 144 on clamp 130C is used to tighten the clamp 130C after the curls 142C engage the mating clamping curls 106. On the clamp 130D, the tightening function is provided by turnkey 146. On the clamp 130F, the tightening function is provided by a screw tightener 148.

Figure 8:
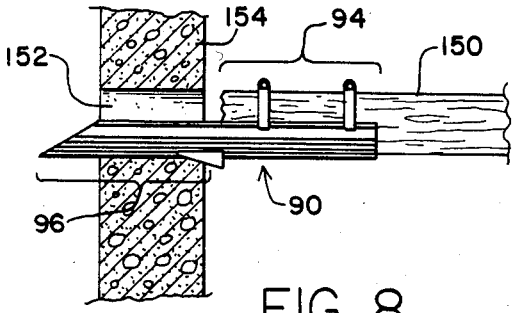
FIG. 8 is a side view of the invention in a different form of installation.

FIG. 8 shows use of the bracket 90 to support a horizontal beam 150 with respect to horizontally disposed aperture 152 in a building wall or foundation 154. The mode of installation may be substantially as shown in FIGS. 3–6, except that the original semicircular cross section configuration of the bracket 90 bends to conform to the rectangular beam 150 and rectangular aperture 152. If desired, the beam 150 may be positioned in end 94 of the bracket 90 after end 96 has been inserted in the aperture 152.

Figure 9:
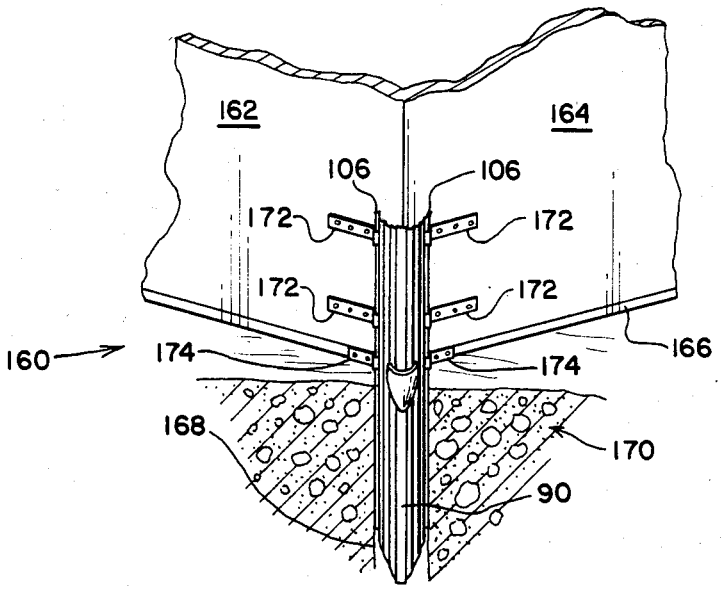
FIG. 9 is a perspective view of the invention in still another installation.

FIG. 9 shows use of the bracket 90 as part of a building corner stake connection construction 160, to support building walls 162 and 164 and floor 166 above aperture 168 in concrete pad 170. Because the brackets 90 have some twisting and bending flexibility, they provide support for seismic loading of the building. Installation of the bracket 90 in aperture 168 is in the same manner as in FIGS. 3–6. The bracket 90 is attached to the walls 162 and 164 by modified clips 172 and 174, shaped to engage the clamping curls 106 and configured for fixed attachment to the walls 162 and 164 or the floor 166, as appropriate.

Figure 10:
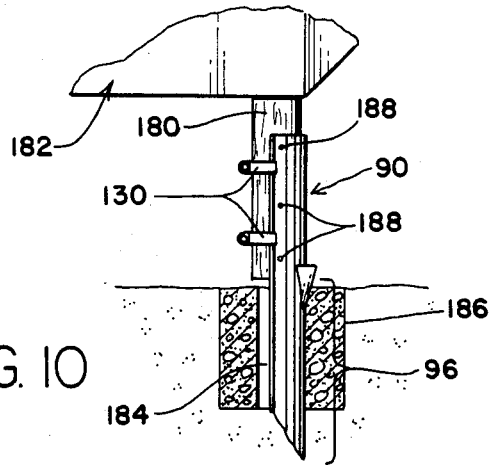
FIG. 10 is a perspective view of a further installation utilizing the invention.

FIG. 10 shows the use of the bracket 90 in a similar building construction, but with the use of a leg 180 to support building 182 above the bracket 90. The bracket 90 may be driven into aperture 184 in concrete 186 either before or after installation of the building 182 above the aperture 184. If desired, the concrete 186 may also be poured around end 96 of the bracket 90. The bracket 90 is fastened to the leg 180 by clamps 130 and screws 188. The bracket is installed in the FIG. 10 structure in the same manner as in FIGS. 3–6.

While the above explanation of the method of this invention has been to support a structural member with respect to a concrete aperture, the method may be practised with other rigid, fixed apertures, such as in wood, rocky soil, adobe and the like. Expansion of the brackets 60 or 90 as a result of the interaction of corrugations 70 or 92, and especially the wedge shaped driving members 72 and 98 to expand the brackets 60 or 90 into tight engagement with such a rigid fixed aperture provides sufficient rigid support in these other apertures as well. The presence of the corrugations 70 and 92 also allows the same bracket 60 or 90 to be used with different size fenceposts, for example from 3½ to 6 inch diameters.

The brackets 60, 90 and 90A can be fabricated from any suitable metallic or nonmetallic material, including composites. The preferred material is steel sheet.

It should now be apparent to those skilled in the art that a single bracket support and method capable of achieving the stated objects of the invention has been provided. The bracket and method of this invention allows a structural member to be supported with respect to a rigid, fixed aperture with only a single support bracket by expanding a portion of the bracket into tight, fixed engagement with the rigid aperture. A single size support bracket may also be used with structural members of different sizes and shapes.

It should further be apparent to those skilled in the art that various changes in form and detail of the invention as shown and described may be made. It is intended that such changes be included within the spirit and scope of the claims appended hereto.

What is claimed is:

1. A bracket for fixedly supporting a structural member with respect to an aperture, comprising a generally channel-shaped body, said body having a first end portion with opposing first and second surfaces for placement on sides of the structural member, said body having a second end portion configured to extend longitudinal beyond the end of the structural member and enter the aperture, said bracket body having a plurality of corrugations extending longitudinal along said bracket body, said bracket body having a wedge shaped impact receiving portion extending outward from the body and extending between the first and the second end portions, said impact receiving portion having an upwardly facing blunt end and a downwardly facing tapered end, said impact receiving portion being positioned so that the downwardly facing tapered end extends into the aperture when the second end portion is driven into the aperture, said impact receiving portion and said corrugations applying force against a wall of the aperture when the second end portion is driven into the aperture to provide a camming action between said impact receiving portion and corrugations and the aperture wall which expands said bracket in at least one dimension to hold said bracket tightly in the aperture, and a means on said first body end portion for fixedly attaching said first body portion to the structural member.

2. The bracket of claim 1 in which the first and second opposed surfaces are on first and second sides of each bracket and the corrugations are on a third side extending between the first and second sides.

3. The bracket of claim 1 in which said bracket body has a generally semicicular cross section.

4. The bracket of claim 3 in which said generally semicircular cross section bracket body has longitudinally extending edges along the opposing first and second surfaces, and a clamping portion extending outward and over the first and second surfaces along the edges.

5. The bracket of claim 3 in which said means for fixedly attaching said first body portion to the structural member comprises a clamp configured to engage said longitudinal extending clamping portions on said first and second surface ends.

6. The bracket of claim 1 in which said wedge shaped impact receiving portion is generally half conical in sahpe, an apex of the half conical shape pointing toward an edge of said second end portion which is configured to enter the aperture.

7. The bracket dssembly of claim 6 in which the edge of said second end portion configured to enter the aperture has sides tapered toward a center line of said second end portion.

8. A bracket for fixedly supporting a structural member with respect to an aperture, comprising a channel-shaped body having a generally semicircular cross section and having a plurality of corrugations extending longitudinally along said body, said body having a first end portion for placement around the structural member and a second end portion with edges tapering toward a longitudinal center line of said body and configured to enter the aperture, said body haivng a wedge shaped impact receiving portion extending outward from the body and extending between the first and the second body portions, said impact receiving portion having an upwardly facing blunt end and a downwardly facing tapered end, said impact receiving portion being positioned so that the downwardly facing tapered end extends into the aperture when the second end portion is driven into the aperture, said impact receiving portion and said corrugations applying force against a wall of the aperture when the second end portion is driven into the aperture to provide a camming action between said impact receiving portion and corrugations and the aperture wall which expands said bracket in at least one dimension to hold said bracket tightly in the aperture, said body having first and second longitudinal extending edges on said first and second end portions, said longitudinally extending edges extending outward and over said body.

9. The bracket of claim 8 in which said impact receiving portion has a plurality of longitudinally extending corrugations.

* * * * *